United States Patent [19]

Wilkinson

[11] Patent Number: 4,709,612

[45] Date of Patent: Dec. 1, 1987

[54] NUT FOR STRINGED INSTRUMENTS

[76] Inventor: Trevor A. Wilkinson, 1075 State St., #201, Redlands, Calif. 92373

[21] Appl. No.: 847,652

[22] PCT Filed: Jul. 25, 1985

[86] PCT No.: PCT/US85/01428

§ 371 Date: Mar. 27, 1986

§ 102(e) Date: Mar. 27, 1986

[87] PCT Pub. No.: WO86/01024

PCT Pub. Date: Feb. 13, 1986

[30] Foreign Application Priority Data

Feb. 27, 1984 [AU] Australia ..... PG6259

[51] Int. Cl.[4] ..... G10D 3/04

[52] U.S. Cl. ..... 84/314 N

[58] Field of Search ..... 84/298, 299, 307–309, 84/312–314

[56] References Cited

U.S. PATENT DOCUMENTS 2,191,776 2/1940 Schreiber ..... 84/314 N 2,905,042 9/1959 Hoyer ..... 84/298 X

FOREIGN PATENT DOCUMENTS 620858 4/1927 France ..... 84/314 N 3996 of 1898 United Kingdom ..... 84/314 N

*Primary Examiner*—Lawrence R. Franklin

*Attorney, Agent, or Firm*—Weissenberger & Peterson

[57] ABSTRACT

A nut for stringed instruments which allows unimpeded movement of the strings within the grooves of the nut for accurate and stable tuning. The nut includes grooves which are flared outwardly and downwardly in the direction of the body of the instrument beyond the support point of the string. The string is supported on rollers which are freely rotatable within the nut, and whose surface protrudes into the grooves to support the strings. The rollers may be circumferentially grooved to maintain the strings in lateral alignment on the nut, and in one embodiment of the invention, they may be of different diameters so as to maintain a constant spacing between each string and a cambered fingerboard.

4 Claims, 3 Drawing Figures

NUT FOR STRINGED INSTRUMENTS

This invention relates to an improved nut for stringed instruments such as guitars or the like.

The majority of stringed instruments employ a nut at the upper end of the neck or fingerboard of the instrument over which the strings of the instrument pass. In many cases, the nut is formed of a strip of metal which is grooved at the appropriate place to locate the string in position, and the grooves are of different width in accordance with the string supported thereon. The presently known above type of nut suffers a number of disadvantages in that the nut does not permit unrestricted travel of the string during playing. Furthermore, the nut does not permit easy and accurate adjustment of the tensioning of the strings to enable tuning of the instrument. For example, when string tension is released, the nut grooves tend to frictionally hold the string and thus give an incorrect indication of the tune of the strings. Accordingly, the instrument tends to go out of tune in use.

The present invention aims to overcome or at least alleviate some of the above disadvantages by providing an improved nut for stringed instruments which enables unrestricted travel of the strings during playing and also permits the use of a vibrato device. The present invention also provides an arrangement which permits easy and accurate tuning of the instrument. Other objects and advantages of the invention will become apparent from the following description.

In order that the invention may be more readily understood and put into practical effect, reference will now be made to the accompanying drawings which illustrate a preferred embodiment of the invention and wherein.

Figure 1:
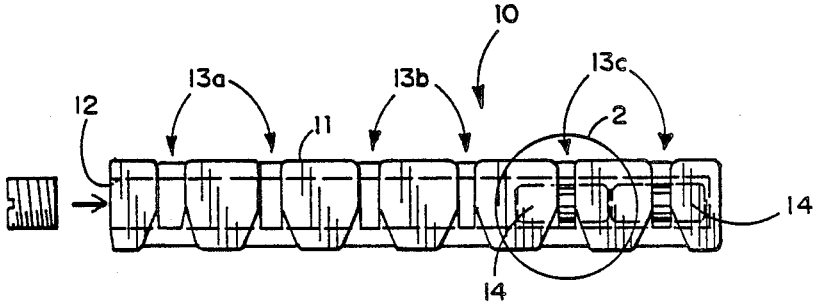
FIG. 1 is an enlarged plan view of a nut according to the present invention.

Referring to the drawings, there is illustrated an improved nut 10 according to the present invention which is adapted to be located at the upper end of the fingerboard of a stringed instrument in place of the normal fixed nut structure. The nut 10 comprises an elongated body 11 formed of metal, plastics or any other suitable material and provided with a longitudinally extending bore 12 therein. A plurality of transversely extending grooves 13 are formed in the top surface of the body 11 so as to intersect the bore 12 and are spaced apart the same distance as the required distance between the strings of the instrument.

Figure 3:
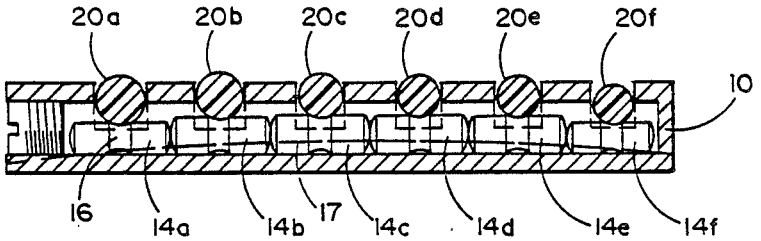
FIG. 3 is a longitudinal vertical section of an embodiment of the invention illustrating the use of rollers of varying sizes to accommodate cambered fingerboards.

As shown in this embodiment, the grooves **13*a* at one end are of relatively large widths to accommodate the greatest diameter strings (as 20*a* and 20*b* in FIG. 3) of the instrument, while the grooves 13*c* are relatively narrow at the opposite end of the body 11 to accommodate the smallest width strings (as 20*e* and 20*f* in FIG. 3). The widths of the intermediate grooves 13*b* are also varied to accommodate the respective strings 20*c* and 20*d***.

Disposed within the bore 12 of the body 11 are a plurality of rollers 14 which are preferably formed of steel or similar hard-wearing material. The rollers 14 may be of a form similar to a needle bearing and are located in the longitudinally extending bore 12 of the nut for free rotation, i.e. they are not mounted on an axle but are free to roll individually in the longitudinal direction of the strings 20 on the bottom surface of the bore 12 as best illustrated in FIG. 3. The rollers may be circumferentially grooved if desired. In the present embodiment, respective rollers 14 are aligned with respective string grooves 13 and thus associated with the respective strings of the instrument. Alternatively, each roller 14 may be associated with a pair of strings and corresponding grooves in, say, a double stringed instrument such as a twelve-string guitar.

Figure 2:
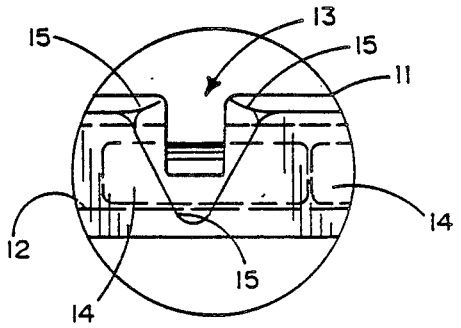
FIG. 2 is an enlarged elevational view showing one of the string locating grooves designated 2 in FIG. 1.

As shown more clearly in FIG. 2, the forward side and lower edges of each groove 13 are cut away or bevelled at 15 to allow for unrestricted vibration of the strings after the strings pass over the rollers 14. Furthermore, it will be noted that the rear portion of the grooves are so shaped as to locate and limit sideways movement of the strings. Sideways movement of the strings may also be controlled by circumferentially extending grooves 16 formed in the needle bearings or rollers 14, each groove being of such size to accommodate at least a portion of the respective strings.

Preferably, the needle bearings or rollers 14 are maintained in position within the body 11 and bore 12 by means of a plug 18 or other means which may be screw-threaded for sealing the open end of the bore 12.

Where a fingerboard of varying camber is employed such as one of arcuate shape, needle bearings or rollers **14*a* through 14*f* of different diameters may be accommodated within the bore 12 to accord with different cambers (such as 17) of fingerboard. Alternatively, where circumferentially grooved rollers are used as in FIG. 3, the depth of the grooves 16** may be varied to compensate for fingerboard camber. Furthermore, the length of each roller may be varied to compensate for different string spacings and fingerboard widths.

In one particular simplified embodiment (not shown) using only two sizes of rollers, **14*a* and 14*f* may be 2 mm. in diameter and the four center rollers 2.5 mm. in diameter. Furthermore, the lengths of the end rollers in this embodiment may be 5 mm. and the length of the four center rollers 7 mm. The lower face of the nut 10** is preferably of planar form to permit it to be affixed in any suitable fashion such as by glue to the instrument.

It will be seen from FIG. 2 that when the instrument is stringed, each string will pass through a respective groove 13 and be supported by the respective roller 14. Thus, tensioning of the string, say for tuning, will result in the string riding on the roller which will rotate so that accurate tuning is achieved. This will ensure that the instrument will not go out of tune during use.

It will thus be seen that the present invention provides a nut for any type of stringed instrument which serves to control height, spacing and scale length of the strings whilst permitting easy tuning and allowing full string vibration in use.

Whilst the above has been given by way of illustrative example of the invention, it will be realized that many modifications and variations as would be apparent to persons skilled in the art may be made to the above described embodiment without departing from the broad scope and ambit of the invention as herein set forth.

I claim:

1. A nut for stringed instruments, comprising:

(a) an elongated body having transversely extending grooves formed in the top surface thereof to receive therein the strings of said instrument and a bore axially formed in said body; and (b) at least one roller so disposed axially therein that it can freely individually roll on the bottom surface of said bore;

(c) the depth of said grooves being such that a portion of the surface of said roller protrudes into said grooves, said strings being supported by said roller surface in said grooves; and (d) each of said grooves having a width slightly larger than the diameter of the string associated with said groove rearwardly of said roller, and flaring outwardly in front of said roller;

(e) whereby said strings are laterally constrained by said groove rearwardly of said roller, and are free to move in any direction forwardly of said roller, and can freely move through said grooves transversely to said nut.

2. The nut of claim 1, in which the underside of the nut is flat, and which comprises a plurality of rollers having different diameters at their point of contact with the strings so as to support the strings equidistantly from the surface of cambered fingerboards when the nut is placed on a flat surface of the instrument.

3. The nut of claim 2, in which said roller surface is substantially cylindrical throughout said groove.

4. The nut of claim 2, in which said roller surface is itself grooved, and said point of string contact diameter is the minimum diameter of said roller surface groove.

* * * * *